US005471760A

United States Patent [19]

Farris

[11] Patent Number: 5,471,760

[45] Date of Patent: Dec. 5, 1995

[54] PICTURE HOOK LOCATOR

[76] Inventor: David R. Farris, 818 River Run, Clarksville, Tenn. 37043

[21] Appl. No.: 374,984

[22] Filed: Jan. 19, 1995

[51] Int. Cl.[6] ..... G01B 3/02

[52] U.S. Cl. ..... 33/613; 33/427

[58] Field of Search ..... 33/613, 464, 427

[56] References Cited

U.S. PATENT DOCUMENTS

| | | | |
|---|---|---|---|
| D. 282,054 | 1/1986 | Hoffman | D10/62 |
| 305,776 | 9/1884 | Amstutz | 33/613 X |
| 3,371,423 | 3/1968 | Paul | 33/464 X |
| 4,220,309 | 9/1980 | Eisen et al. | 248/542 |
| 4,241,510 | 12/1980 | Radecki | 33/613 |
| 4,517,860 | 5/1985 | Dameron, Jr. | 81/487 |
| 4,637,583 | 1/1987 | Babitz | 248/544 |
| 4,753,014 | 6/1988 | Vrajich | 33/613 |
| 4,893,776 | 1/1990 | Floyd | 248/475.1 |
| 4,947,616 | 8/1990 | Sorton | 33/613 |
| 5,080,317 | 1/1992 | Letizia | 248/544 |
| 5,103,573 | 4/1992 | Ehling et al. | 33/613 |
| 5,129,154 | 7/1992 | Aydelott | 33/613 |
| 5,180,135 | 1/1993 | Hindall | 248/544 |
| 5,361,510 | 11/1994 | Cox | 33/613 |

FOREIGN PATENT DOCUMENTS

| | | |
|---|---|---|
| 1481118 | 3/1966 | France . |
| 758706 | 10/1956 | United Kingdom . |
| WO91/18541 | 12/1991 | WIPO . |

*Primary Examiner*—Alvin Wirthlin

*Attorney, Agent, or Firm*—Jacobson, Price, Holman & Stern

[57] ABSTRACT

An apparatus is provided for removable support from a framed member to be hung and with the hanging wire of the framed member being upwardly deflected and tightened as though supporting the weight of the framed member. The apparatus includes an upstanding channel incorporating a single outstanding and upwardly opening hook adjacent its lower end for engaging the longitudinal mid-portion of a picture frame hanging wire and the upper portion of the channel includes a slide adjustably positionable along the channel and defining a downwardly facing, plane abutment surface normal to the longitudinal extent of the channel for downwardly abutting the upper margin of the frame from which the hanging wire is supported. The single hook may be substituted for by a pair of oppositely laterally offset hooks for use in determining the desired location of a pair of frame hanging hooks.

10 Claims, 2 Drawing Sheets

PICTURE HOOK LOCATOR

BACKGROUND OF THE INVENTION

1. Field of the Invention

This invention relates to an improved apparatus for locating the point at which a single hook or two points at which two hooks or other hanging means may be attached to a wall or other suitable surface for supporting a picture frame or the like in the desired position.

2. Description of Related Art

Various different forms of picture hanging devices and other structures including some of the general structural and operational features of the instant invention heretofore have been provided. Examples of these previously known devices are disclosed in U.S. Pat. Nos. 4,220,309, 4,517,860, 4,893,776, 5,080,317; U.S. Pat. No. Des. 282,054; British Patent No. 758,706; French Patent No. 1,481,118; and International Patent Application No. PCT/GB91/00923 (International Publication No. WO 91/18541), published Dec. 12, 1991.

However, these previously known devices do not include the overall basic combination of structural and operational features included in the instant invention.

SUMMARY OF THE INVENTION

The picture hook locating device of the instant invention includes a main upright member having front and rear faces and which is of sufficient width and rigidity to permit a center slot to be formed therein and to extend nearly the full length thereof without rendering the main upright member flimsy. The rear face of the main member is a flat surface except for a small hook protrusion near the lower end of the main member that extends outward from the flat rear face. The hook protrusion has a notch, mark or hole that is on the centerline of the aforementioned slot. A marking tool may be inserted through the notch, mark or hole to mark the wall at a location which will determine the location for securing a hook to the wall A spirit level is recessed in the main member to enable a user to support the main member in a vertical orientation when the device is positioned against a vertical surface such as a wall or the like upon which a framed object or the like is to be hung.

A sliding abutment member is attached to the rear of the main member and has a locating pin slidably engaged in the aforementioned slot. The abutment member is slidably mounted from the main member and is maintained against angular displacement relative thereto. The sliding abutment member includes a lower horizontal surface which may be somewhat greater in length than the width of the main member and is provided to abut the top edge of a framed object. By maintaining the sliding abutment member against angular displacement relative to the main member, the abutment surface is maintained normal to the slot and the longitudinal extent of the main upright member. Furthermore, the lower horizontal surface of the abutment member has a notch or opening on the centerline of the slot for observing the center point of the upper margin of a framed member and a registered removable mark upon the wall which will be top and center of the framed member after it is hung on the wall. Also, structure is provided for securing the abutment member to the main member at any position along the length of the aforementioned slot.

A separate horizontal member is provided as an attachment component of the invention and can be removably attached to the main upright member. The length of the separate horizontal member is sufficient to permit sets of hook protrusions to be located on the back of the horizontal member at points spaced therealong. These hook protrusions are equally spaced horizontally left and right of the center point of the horizontal member mounted to the main upright member in alignment with the aforementioned center slot. All of these hook protrusions on the separate horizontal member have a notch, mark or hole in the separate horizontal member registered therewith. A marking tool may be inserted through a selected set of notches, marks or holes to mark the wall at locations which will determine the locations for securing two hooks to the wall. The use of a pair of hooks greatly minimizes picture tilt and slippage, thereby insuring that the upper edge of the framed object is precisely maintained horizontal.

The main object of this invention is to provide an apparatus removably attachable to a framed object and positionable against an upright surface from which the framed object is to be hung and further to an apparatus which may be utilized to precisely mark the upright surface (or a piece of tape or paper adhered thereto) at the point a hook to be used in supporting the framed object is to be secured to the upright surface.

Another object of this invention is to provide an apparatus in accordance with the preceding object and which will be effective in enabling the user to secure a hook to an upright surface from which a framed object is to be hung in precise position on the upright surface.

A further object of this invention is to provide an apparatus in accordance with the preceding objects and which will be readily effectively usable by even unskilled persons.

Another important object of this invention is to provide an apparatus which may be used to precisely mark the location of multiple mounting hooks as well as single mounting hooks to be used in hanging a framed object from an upright surface.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
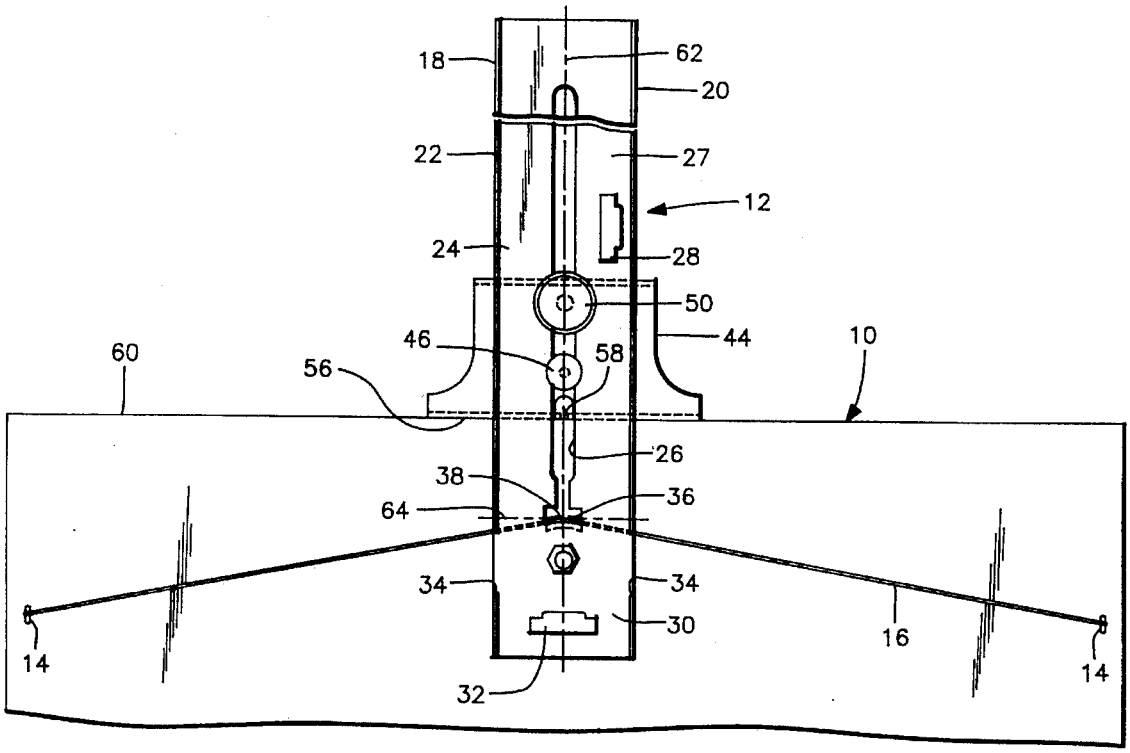
FIG. 1 is a front elevational view of the picture hook locator of the instant invention as applied to a framed object to be hung through the utilization of a single upstanding surface mounted hook.

Referring now more specifically to the drawings the numeral 10 in FIG. 1 generally designates a framed member to be hung on an upstanding surface and the numeral 12 generally designates the hook locator of the instant invention.

The framed member 10 includes a pair of opposite side eyes 14 from which the opposite ends of a wire 16 are supported. The length of the wire 16 is slightly greater than the horizontal distance between the eyes 14 in order that the longitudinal midportion of the wire 16 may be upwardly deflected as apparent from FIG. 1.

The hook locator 12 includes an upstanding main or support member 18 which is channel shaped in cross section including a pair of forwardly directed opposite side flanges 20 and 22 interconnected by a rear bight portion 24. The bight portion includes a longitudinal slot 26 formed therein along the longitudinal centerline of the support member 18 and an upper portion 27 of the support member 18 includes a vertical spirit level 28 inset therein and viewable from either the front or rear sides of the support member 18 while a lower portion 30 of the support member 18 includes a similar inset horizontal spirit level 32. Further, the flanges 20 and 22, in the lower portion 30, include windows or notches 34 formed therein for a purpose to be hereinafter more fully set forth. Also, the lower end of the slot 26 terminates at a rearwardly struck and upwardly opening hook defining portion 36, see FIG. 3, which is centrally notched as at 38.

Figure 4:
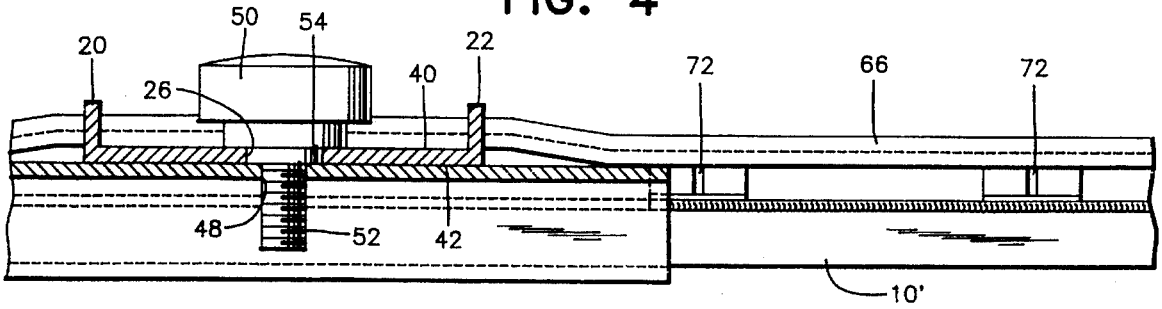
FIG. 4 is a fragmentary horizontal sectional view taken substantially upon the plane indicated by the section line 4—4 of FIG. 3.

The support member 18 defines a rear face 42, FIG. 4, which is substantially planar and a front face 40 disposed between the flanges 20 and 22. Further, an abutment member or slide 44, FIG. 1, is provided and includes a forwardly projecting guide pin 46 removably supported from slide 44 as at 47, FIG. 3, and snugly slidable in the slot 26 and a threaded bore 48 vertically registered with the guide pin 46, a locking knob 50 having its threaded shank portion 52 inserted through the slot 26 from the front face 40 and threadingly engaged in the bore 48. The knob 50 includes an enlarged intermediate size smooth shank 54 also snugly and slidably received in the slot 26. The abutment member or slide 44 thus slidably engages the rear face 42 of the support member 18. In addition, the abutment member or slide 44 includes a planar undersurface 56 disposed normal to the longitudinal centerline of the support member 18 and which is centrally interrupted as at 58 to provide a window whereby a surface upon which the undersurface 56 is abutted may be viewed from either the front or rear side of the support member 18.

When utilizing the hook locator 12 in its configuration illustrated in FIG. 1, the width and height of the framed member 10 are first determined and recorded. Then, the center of the upper margin 60 of the framed member 10 is determined and marked on a piece of paper or tape removably secured to the upper margin 60. Thereafter, utilizing the predetermined width and height dimensions of the framed member 10, the desired picture location on a wall or other upstanding surface may be determined and a piece and/or tape may be removably secured to the wall or upstanding surface in that general location and the precise center point of the upper margin 60 of the framed member 10 (when properly positioned) may be made on the wall mounted paper or tape. Thereafter, short crossed vertical and horizontal lines may be made on the wall mounted paper or tape to indicate the precise intersection of a first horizontal plane containing the upper surface of the upper margin 60 of the framed member 10 and a second plane normal to the first plane and centrally disposed relative to the slot 26, the intersection of these two planes then indicating the location as at 58 in FIG. 1 with which the central marking on the upper margin 60 will be aligned.

Thereafter, the hook locator 12 is engaged with the upper margin 60, FIG. 1, and wire 16 of the framed member 10 in the manner illustrated in FIG. 1 of the drawings with the abutment member or slide 44 moved downwardly along the support member 18 so that the undersurface 56 abuts the upper edge 60 when the wire 16 is tight as though supporting the weight of the framed member 10. In this manner, the framed member 10 is clamp supported between the undersurface 56 and the eyes 14 (from which the tightened wire 16 is supported) against shifting relative to the hook locator 12 and with the upper edge 60 normal to the slot 26. Then, the knob 50 is tightened in order to releasably retain the adjusted position of the abutment member or slide 44 and the hook locator 12 is disengaged from the framed member 10 and moved to the wall or upstanding surface upon which the framed member is to be hung.

Then, the support member 18 is engaged with the wall in a vertical position determined by the spirit level 32 and the point 58 determined by the interruption of the under surface 56 is registered with the mark upon the wall. Thereafter, while the support member is still vertically disposed, a marking tool is inserted through the notch 38 to mark the wall at a location which will define the upper surface of whatever hook member is to be engaged with the wire 16 in supporting the framed member 10 from the wall or upstanding surface. After the wall has thus been marked, the hook member to be used has its upwardly facing surface to be engaged by the wire 16 aligned with the mark on the wall and the location of the nail, screw or other fastener to be used in supporting the hook from the wall is then marked on the wall in proper orientation relative to the previous mark made on the wall through the notch 38. Thereafter, the hook may be secured to the wall and the framed member 10 may have its wire 16 engaged with the hook.

By utilizing the hook locator 12 in the above manner, the precise location of the hook or other similar structure to be used in supporting the framed member 10 from a wall or other upstanding surface may be properly determined.

It is also pointed out that, if the framed member 10 is to be utilized in determining the proper hook location on a wall by a person actually visualizing various positions of the framed member 10 on the wall, the hook locator 12 may be engaged with the framed member 10 in the manner illustrated in FIG. 1 and the framed member 10 may be held in position upon the wall with the support member 18 in vertical position. Then, after the desired positioning of the framed member 10 has been determined, a mark may be made upon the wall with a suitable marking tool as at 58. Thereafter, the hook locator 12 may be removed from engagement with the framed member 10 and immediately thereafter placed upon the wall with the previous mark registered with the hook locator 12 as at 58 and a new lower mark may then be made on the wall or vertical surface through the notch 38.

The first horizontal plane defined by the under surface 56 intersects with a second plane 62 normal to the first plane as at 58. Further, a third (horizontal) plane 64 intersects with the second plane 62 at the notch 38.

Figure 2:
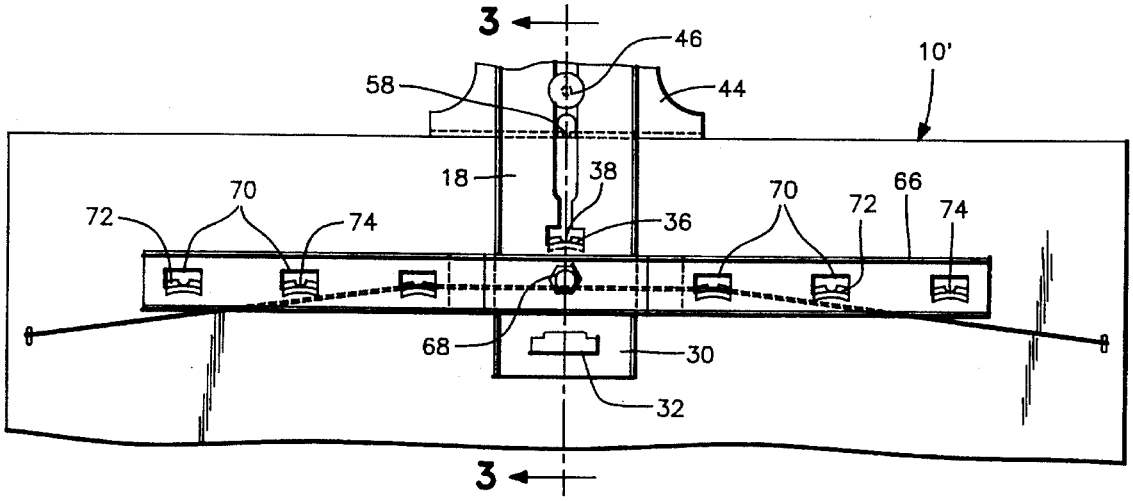
FIG. 2 is a fragmentary front elevational view of the hook locator with an attachment mounted thereon operative to precisely locate a pair of mounting hooks on an upright surface to greatly minimize picture tilt and slippage.
Figure 3:
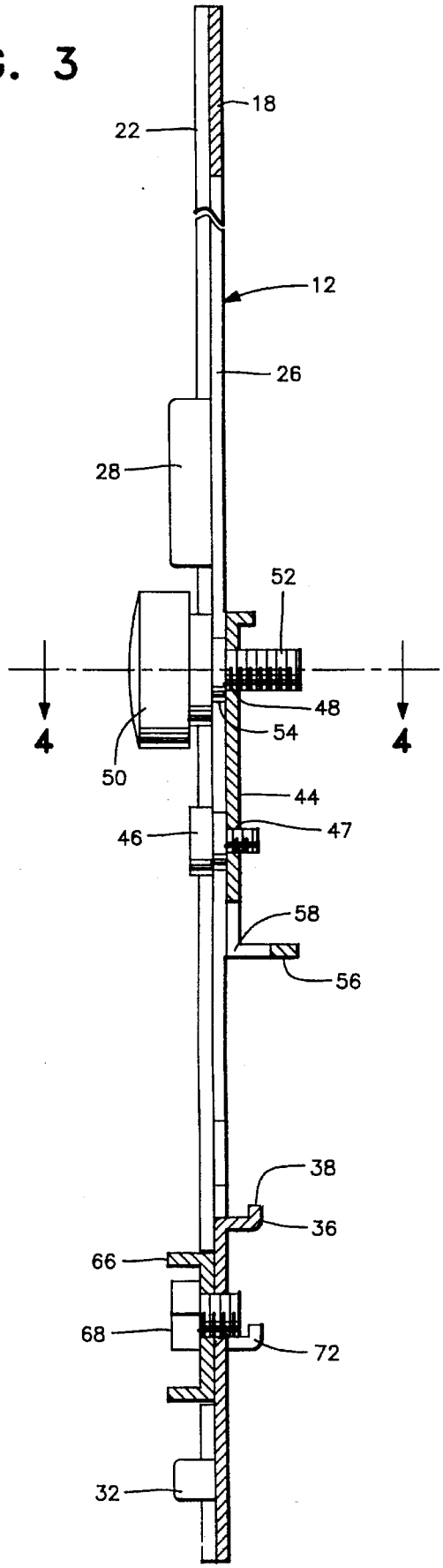
FIG. 3 is an enlarged fragmentary vertical sectional view taken substantially upon the plane indicated by the section line 3—3 of FIG. 2.

With attention now invited more specifically to FIGS. 2, 3 and 4, there will be seen a channel shaped adapter 66 secured to the lower portion 30 of the support member 18 by a through fastener 68, the adaptor 66 being channel shaped and tightly received in the notches 34 formed in the flanges 20 and 22. The adaptor 66 has three sets of opposite side windows 70 formed therein by laterally outwardly struck portions 72 centrally notched as at 74, thereby defining hook defining portions corresponding to the hook defining portion 36. Of course, as will be apparent from FIG. 2, the adapter 66 may be utilized to locate a pair of hook locations to be used in supporting framed member 10' so as to greatly minimize tilt and slippage. The spacing between the pair of hook members to be used in supporting the framed member 10' may of course be selected as desired.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A picture hook locator including a vertical support member having a front face, a rear face adapted to closely oppose a wall surface, and upper and lower portions, said lower portion including laterally outwardly projecting and upwardly opening hook structure projecting slightly outwardly of said rear face and adapted to cradle, from beneath, a picture frame wire extending thereover, an abutment member shiftably supported from said support member for guided movement up and down said support member along a predetermined upright path and defining downwardly facing abutment surface means disposed in a first horizontal plane normal to said path and including portions thereof spaced on opposite sides of a second vertical plane normal to the first plane and containing said path, said abutment surface means projecting rearwardly of said rear face for abutting engagement with the upper edge of a picture frame from which said wire is supported, and means operative to releasably retain said abutment member in adjusted position along said path for maintaining said picture frame clamp supported, between said upper edge and said wire, from said locator with said wire tensioned as though supporting the weight of said frame, thus preventing displacement of said frame relative to said hook locator.

2. The picture hook locator of claim 1 wherein said hook structure is substantially centered in said second plane.

3. The picture hook locator of claim 1 wherein said hook structure includes at least two hook members spaced equally on opposite sides of said second plane and disposed in a third plane paralleling and spaced below said first plane.

4. The picture hook locator of claim 1 wherein said hook structure includes at least one pair of hook members disposed on each opposite side of said second plane and spaced unequally along said third plane from said second plane.

5. The picture hook locator of claim 4 wherein said pairs of hook members are carried by and spaced apart longitudinally along an elongated horizontal bar carried by said lower portion.

6. The picture hook locator of claim 5 wherein said horizontal bar and support member include coacting means removably supporting said horizontal bar from said support member.

7. The picture hook locator of claim 1 including a horizontal spirit level supported from said support member for indicating a horizontal direction normal to said path.

8. A picture hook locator including an upright elongated member having front and rear faces, an abutment member mounted from said elongated member for up and down adjustment relative thereto along a predetermined path, upwardly opening hook structure projecting slightly outwardly of said rear face and substantially centered relative to said path, said abutment member defining downwardly facing abutment surface. portions disposed on opposite sides of said path and in a first horizontal plane normal to said path for maintaining a picture frame clamp supported, between the upper edge of the frame and the frame hanging wire, from said locator with side wire tensioned as though supporting the weight of said frame, thus preventing displacement of said frame relative to said hook locator, said elongated member defining means for facilitating marking a wall surface, against which said rear face is abutted, at a location substantially disposed in an upright second plane normal to said first plane and containing said path and a third plane paralleling said first plane and containing said hook structure.

9. The hook locator of claim 8 wherein said hook structure includes at least two hook members spaced equally on opposite sides of said second plane and disposed in said third plane.

10. The hook locator of claim 8 including a horizontal spirit level supported from said support member for indicating a horizontal direction normal to said path.

* * * * *